United States Patent [19]

Mueller

[11] Patent Number: 4,732,089

[45] Date of Patent: Mar. 22, 1988

[54] GUIDED TABLETOP PLATFORM

[75] Inventor: Lee G. Mueller, Kewaunee, Wis.

[73] Assignee: Hamilton Industries, Inc., Two Rivers, Wis.

[21] Appl. No.: 910,449

[22] Filed: Sep. 22, 1986

[51] Int. Cl.[4] ..... A47B 11/00

[52] U.S. Cl. ..... 108/102; 108/143

[58] Field of Search ..... 108/102, 90, 91, 137, 108/143, 93, 92; 248/1 A, 1 B, 1 E, 1 C, 662, 660

[56] References Cited

U.S. PATENT DOCUMENTS

| | | | |
|---|---|---|---|
| 794,809 | 7/1905 | Marsh | 108/143 |
| 1,639,387 | 8/1927 | Seward | 108/102 |
| 2,182,703 | 12/1939 | Rainwater | 108/143 X |
| 2,741,520 | 4/1956 | Mares | 108/102 |
| 2,870,916 | 1/1959 | Bonia et al. | 108/102 X |
| 3,210,143 | 10/1965 | Frederick | 108/102 X |
| 3,643,605 | 2/1972 | Miller | 108/6 |
| 3,702,209 | 11/1972 | Moore | 312/196 |
| 3,919,949 | 11/1975 | Rendleman | 108/27 |
| 4,145,097 | 3/1979 | Naess | 248/1 B |
| 4,515,086 | 5/1985 | Kwiecinski | 108/96 |
| 4,561,619 | 12/1985 | Robillard et al. | 248/1 B |
| 4,589,349 | 5/1986 | Gebhardt | 108/102 |
| 4,637,666 | 1/1987 | Worrell et al. | 108/143 X |

FOREIGN PATENT DOCUMENTS

| | | | |
|---|---|---|---|
| 268061 | 10/1962 | Australia | 108/90 |
| 647622 | 1/1960 | Canada | 108/143 |
| 1165043 | 3/1964 | Fed. Rep. of Germany | 108/143 |
| 3003017 | 7/1981 | Fed. Rep. of Germany | 248/1 E |

*Primary Examiner*—Kenneth J. Dorner
*Assistant Examiner*—José V. Chen
*Attorney, Agent, or Firm*—Tilton, Fallon, Lungmus

[57] ABSTRACT

A roller-equipped platform movably supported upon a tabletop having a straight, accessible rear edge, the platform including a straight depending flange received in a guide channel defined by the rear edge of the tabletop and a guide track secured to that rear edge. Stop elements at opposite ends of the track limit the extent of sideways movement of the platform upon the tabletop.

13 Claims, 4 Drawing Figures

GUIDED TABLETOP PLATFORM

BACKGROUND AND SUMMARY

Movable platforms for supporting word processors, CRT display units, and other equipment are well known as disclosed, for example, in U.S. Pat. Nos. 4,515,086, 3,919,949, 3,702,209, and 3,643,605. In general, such platforms are mounted on adjustable arms or on swivel bases and, if they are guided for movement over a work surface, guide tracks either project upwardly from that surface or are recessed into the surface. In either of the latter cases, removal of the platform leaves the work surface with obstructions or recesses that may interfere with effective use of that surface and, in any event, are unattractive and undesirable.

An important aspect of this invention therefore lies in providing an assembly including a movable tabletop platform which requires no attachments or alterations in the work surface of the tabletop and which may therefore be removed when not needed without leaving any obstructions, holes, grooves, or other disfigurements on or in that surface. Nevertheless, the platform assembly does include guide means for guiding movement of the platform in a rectilinear path across the rear portion of the work surface and for limiting the extent of such travel along that surface.

Briefly, the assembly includes a generally rectangular platform having a top wall and depending front, side, and rear flanges defining a shallow downwardly-facing cavity or recess. A plurality of rollers are mounted within that cavity with their rotational axes parallel with the side flanges of the platform and with their bottom surfaces projecting slightly beneath the lower limits of the front and side flanges. The rear flange of the platform is provided with a rigid extension that projects substantially below the lower limits of the rollers and extends along a plane perpendicular to the platform's top wall and normal to the rotational axes of the rollers. An elongated track, considerably longer than the width of the platform, is secured to the rear surface of a tabletop to define an elongated guide channel for receiving the rear flange extension of the platform and for guiding movement of the platform across the tabletop's work surface. The track includes stop elements at its ends for engaging the rear flange extension and limiting the extent of platform movement along the track.

The platform is relatively simple and inexpensive in construction but is rugged enough to support relatively heavy equipment upon a table surface. The rollers are carried by elongated channel members and those members are mounted within the cavity of the platform in such a way as to reinforce and rigidify the platform as a whole. The elongated cylindrical rollers make substantial contact with the surface on which the platform is supported, thereby distributing the load carried by the platform and insuring that movement of the platform may be easily effected even when the platform supports a relatively heavy piece of equipment.

Other features, objects, and advantages of the invention will become apparent from the specification and drawings.

DRAWINGS

DETAILED DESCRIPTION OF PREFERRED EMBODIMENT

Figure 1:
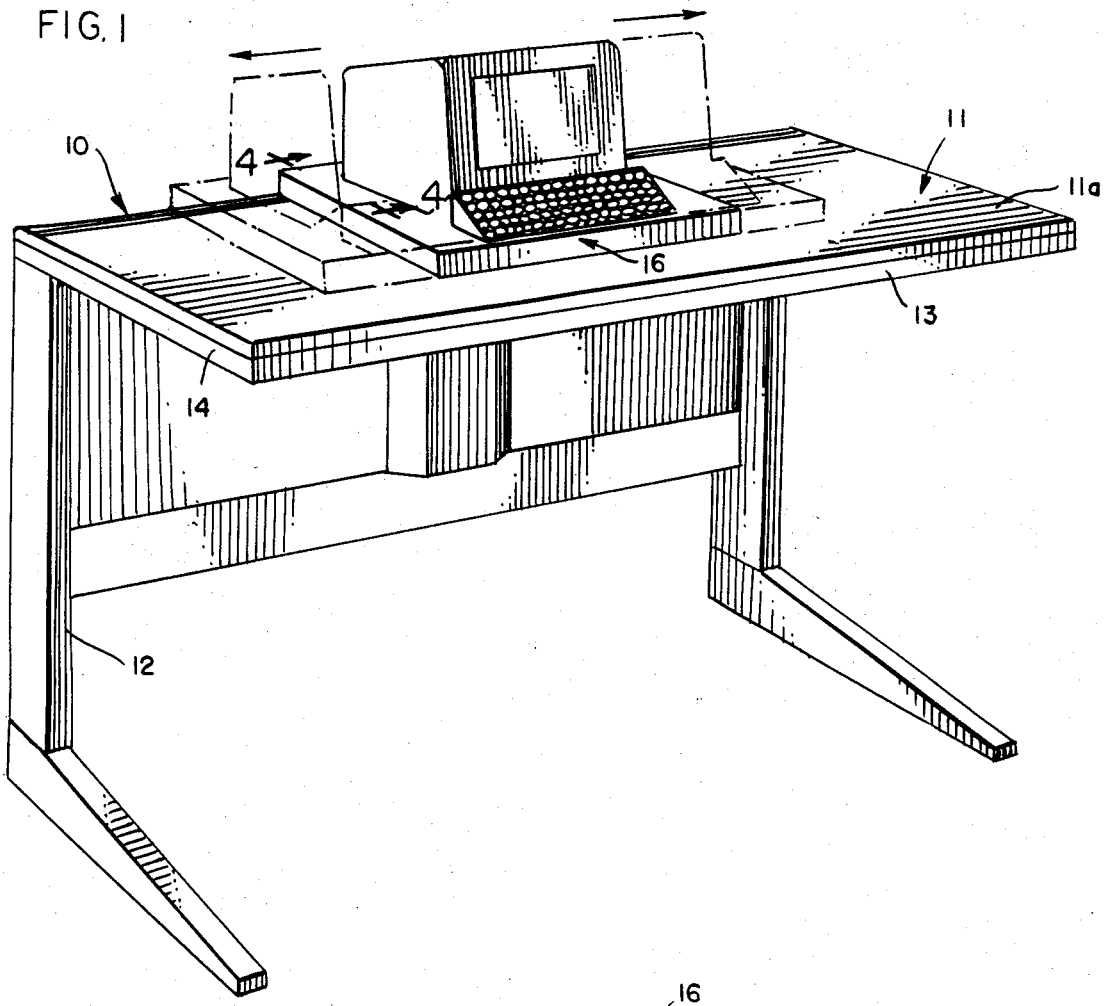
FIG. 1 is a perspective view of a work table on which is mounted a movable platform supporting, by way of example, a CRT unit.

Referring to the drawings, the numeral 10 generally designates a work table having a horizontal top 11 and a base 12. The top has a planar work surface 11*a* and straight front, side, and rear surfaces or edges 13–15, respectively.

A platform assembly comprises two main components: a platform 16 and platform guide means 17. As shown most clearly in FIGS. 2 and 3, the platform 16 has a planar top wall 18 and integral depending front, side, and rear flanges 19–21, respectively. The platform is preferably rectangular in outline and, in any event, the rear flange 21 should be straight. The top wall and depending flanges together define a shallow downwardly-facing cavity or recess 22.

Within the cavity is at least one and preferably two or more elongated channel members or beams 23. The members extend substantially the full width of the cavity and are of generally inverted U-shaped cross section with horizontal top walls 23*a* and depending side walls 23*b*. The top walls 23*a* of the channel members engage the undersurface of the platform's top wall or panel 18, thereby reinforcing that panel and the platform in general. Further reinforcement may be attained by welding or otherwise permanently securing the channel members and platform top together as indicated by spot welds 24 in FIG. 3.

The side walls 23*b* have aligned openings near the ends of each channel member 23 for receiving and retaining the ends of pins or axles 25 that support rollers 26. Each roller is in the shape of an elongated cylinder extending substantially the full distance between the side walls 23*b* of the channel member 23 in which it is supported. Only a small portion 26*a* of each roller projects downwardly below the lower limits of the side walls 23*b* of the channel members and the front and side flanges 19 and 20 of the platform.

Figure 3:
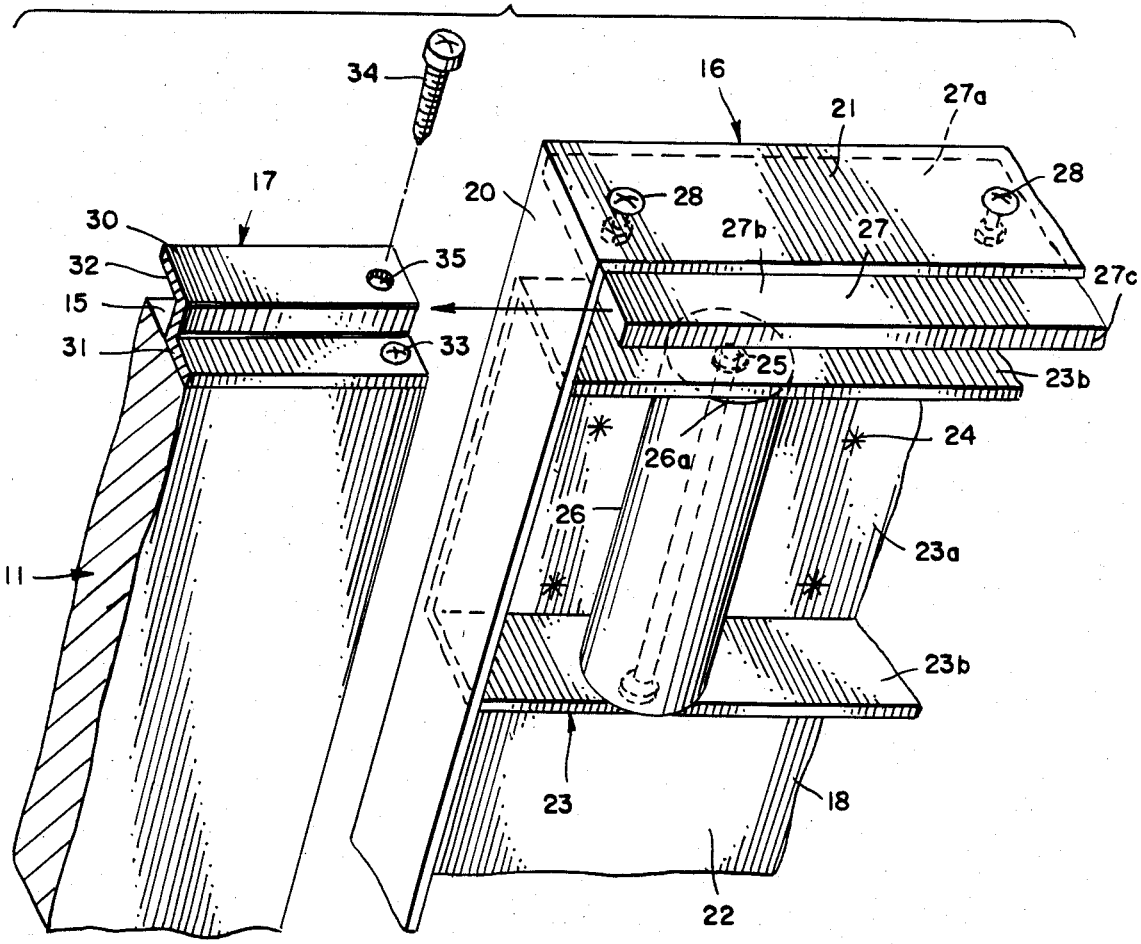
FIG. 3 is a still further enlarged fragmentary perspective view illustrating the platform and tabletop as viewed from their undersides as the depending flange extension of the platform is about to be slid into the channel defined by the guide track and tabletop.

The straight rear flange 21 of the platform is provided with an extension that projects downwardly below the lower limits of the rollers 26. The rear flange extension takes the form of a horizontally-elongated rigid bar 27 that extends along the rear of the platform and has a height considerably greater than the vertical dimension of cavity 22. The bar is of rectangular outline with an upper portion 27*a* that is secured to rear flange 21 by bolts 28, or by any other suitable means, and a lower portion 27*b* that projects downwardly below the lower surfaces of the rollers, terminating in a straight horizontal edge 27*c* (FIG. 3). While only a single bar 27 is shown, two or more bars in series alignment alternatively may be used.

Figure 2:
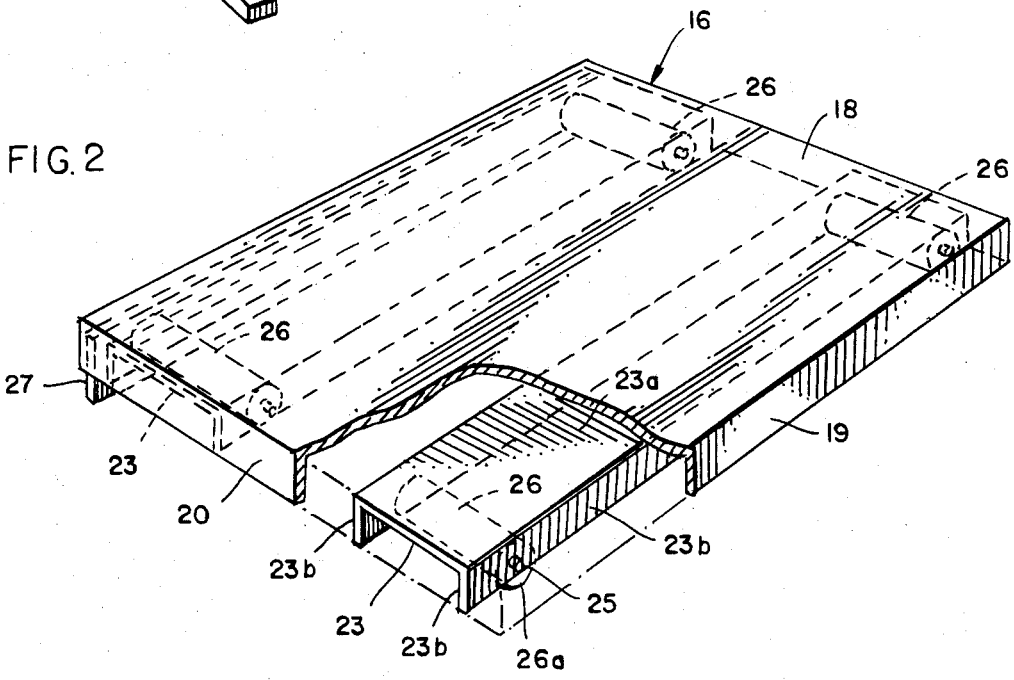
FIG. 2 is a perspective view of a platform with a portion thereof cut away to illustrate details of its construction.
Figure 4:
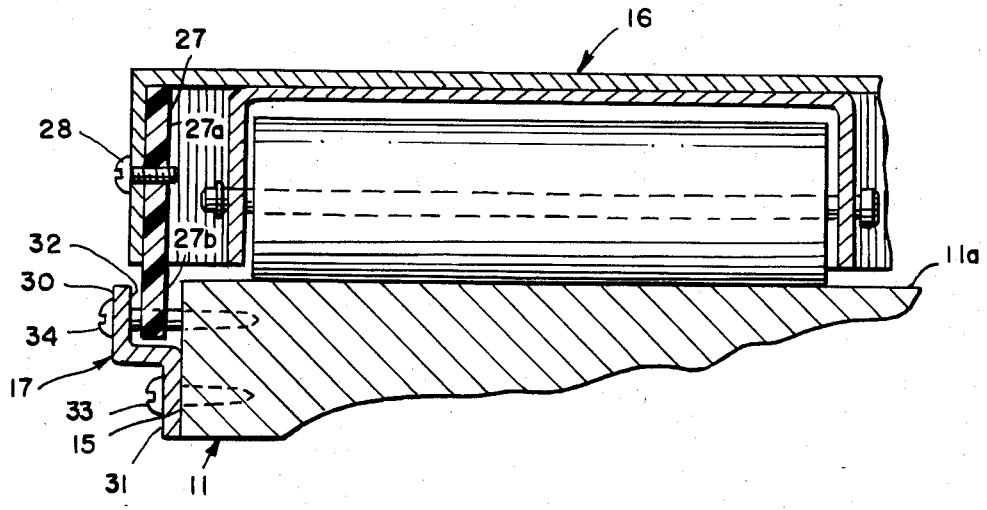
FIG. 4 is an enlarged fragmentary vertical sectional view taken along line 4—4 of FIG. 1.

Guide means for the platform takes the form of a straight, elongated guide track 17 which, when viewed in section, has offset upper and lower flange portions 30 and 31, respectively. As shown in FIGS. 3 and 4, the vertical dimensions of the guide track do not exceed the thickness of the tabletop 11. Because of its offset, the guide track defines a recess 32 which cooperates with rear flange extension or bar 27 to guide movement of the platform 16 along the work surface of top 11. More specifically, when the lower flange portion 31 of the guide track is secured to the rear surface 15 of the top by screws 33 or by other appropriate fastening means, the offset guide track and the tabletop define a upwardly opening guide channel for slidably receiving the depending lower portion 27*b* of the rear flange extension or bar 27 (FIG. 2). The guide track 17 extends the full width of the tabletop and is considerably longer than the width of the platform. Stop means in the form of screws 34 extend through openings 35 in the guide track and into recess 32 to obstruct travel of the platform at the ends of the track. It is believed apparent that such stop means may take other forms, such as pins or other obstructions at the ends of the channel; however, screws are believed particularly effective because they extend through the channel and into the tabletop 12, providing greater security for the stop means and at the same time reinforcing the attachment between the guide track and tabletop.

The elongated guide bar 27 which serves as a downward extension of the platform's rear flange 21 may be formed of any rigid and durable material but rigid plastics such as polyethylene, polypropylene, polyformaldehydes, or polycarbonates are preferred. Rigid polymeric materials are desirable because they promote smoothness and quietness of operation as the platform moves from one side of the work surface to the other. Platform 16 and reinforcing channel members 23 are preferably formed of steel or other rigid sheet material.

Removal of the platform is achieved simply by lifting it off of the work surface. When removed, the work surface is left clear and unobstructed. Since the guide track extends along the rear of the tabletop and does not project above the work surface, its presence cannot interfere with full use of that surface.

While in the foregoing I have disclosed an embodiment of the invention in considerable detail for purposes of illustration, it will be understood by those skilled in the art that many of these details may be varied without departing from the spirit and scope of the invention.

I claim:

1. A platform assembly for tabletop use, comprising a platform having an enlarged planar top wall and front, side, and rear flanges depending from the periphery of said top wall and together defining a shallow, downwardly-facing cavity; a plurality of axially-elongated cylindrical rollers mounted within said cavity adjacent said front and rear flanges with their rotational axes disposed in spaced parallel relation and their lower portions projecting beneath said side and front flanges; said rear flange extending along a vertical plane normal to the axes of said rollers and including an extension projecting substantially below said rollers; and track means substantially longer than the width of said platform and adapted to be affixed to a vertical rear surface of a tabletop; said track means defining an elongated upwardly-facing guide channel for receiving said rear flange extension and for guiding movement of said platform therealong.

2. The platform assembly of claim 1 in which said track means is provided with stop means extending into said guide channel adjacent opposite ends thereof for engaging said rear flange extension and limiting the extent of movement of said platform along said track means.

3. The platform assembly of claim 2 in which said track means is provided with openings adjacent opposite ends thereof; said stop means comprising screws extending through said openings and transversely through said channel for restraining said rear flange extension from longitudinal movement beyond the ends of said channel.

4. The platform assembly of claims 1, 2, or 3 in which said rear flange extension comprises an elongated rigid guide bar extending downwardly into said cavity along said rear flange and secured to the inner surface of said rear flange.

5. The platform assembly of claim 4 in which said rigid guide bar is formed of polymeric material.

6. The platform assembly of claim 1 in which at least one elongated U-shaped channel member is disposed within said cavity for mounting said rollers and reinforcing said platform; said channel member having a top wall engaging the undersurface of the top wall of said platform and having a pair of depending longitudinal side walls; said rollers being carried by pins extending through aligned openings in said side walls of said channel member.

7. In combination, a table having a tabletop with a horizontal work surface and a straight, vertical rear surface; a platform supported on said work surface; said platform having a top wall and having front, side, and rear flanges depending from the periphery of said top wall and together defining a shallow, downwardly-facing cavity; a plurality of rollers mounted within said cavity adjacent said front and rear flanges with their rotation axes disposed in spaced parallel relation and their lower portions projecting beneath said side and front flanges and supported on said work surface; said rear flange extending along a vertical plane normal to the axes of said rollers and including an extension projecting substantially below said rollers along said rear surface of said tabletop; and track means secured to said tabletop along the rear surface thereof, and below said work surface, for defining an elongated upwardly-facing guide channel slidably receiving said rear flange extension for guiding movement of said platform across said work surface and adjacent said rear surface.

8. The combination of claim 7 in which said track means is provided with stop means extending into said guide channel adjacent opposite ends thereof for engaging said rear flange extension and limiting the extent of movement of said platform along said track means.

9. The combination of claim 8 in which said track means is provided with openings adjacent opposite ends thereof; said stop means comprising screws extending through said openings and transversely through said channel for restraining said rear flange extension from longitudinal movement beyond the ends of said channel.

10. The combination of claims 7, 8, or 9 in which said rear flange extension comprises an elongated rigid guide bar extending into said cavity along said rear flange and secured to the inner surface of said rear flange.

11. The combination of claim 10 in which said rigid guide bar, is formed of polymeric material.

12. The combination of claim 7 in which said rollers are in the shape of elongated cylinders.

13. The combination of claim 12 in which at least one elongated U-shaped channel member is disposed within said cavity of said platform for mounting said rollers and reinforcing said platform; said channel member having a top wall engaging the undersurface of the top wall of said platform and having a pair of depending longitudinal side walls; said rollers being carried by pins extending through aligned openings in said side walls of said channel members.

* * * * *